US008268539B2

(12) United States Patent
Ikegame et al.

(10) Patent No.: US 8,268,539 B2
(45) Date of Patent: Sep. 18, 2012

(54) METHOD OF MANUFACTURING LIQUID EJECTION HEAD

(75) Inventors: Ken Ikegame, Atsugi (JP); Isamu Horiuchi, Yokohama (JP)

(73) Assignee: Caron Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/177,765

(22) Filed: Jul. 7, 2011

(65) Prior Publication Data

US 2012/0021360 A1 Jan. 26, 2012

(30) Foreign Application Priority Data

Jul. 23, 2010 (JP) ..... 2010-166001

(51) Int. Cl.
*B41J 2/16* (2006.01)

(52) U.S. Cl. ..... 430/320; 430/330

(58) Field of Classification Search ..... None
See application file for complete search history.

(56) References Cited

U.S. PATENT DOCUMENTS

| | | | | |
|---|---|---|---|---|
| 5,478,606 | A * | 12/1995 | Ohkuma et al. | 427/555 |
| 8,037,603 | B2 | 10/2011 | Fujii et al. | |
| 2004/0070643 | A1 * | 4/2004 | Kubota et al. | 347/20 |
| 2005/0155949 | A1 * | 7/2005 | Park et al. | 216/27 |

FOREIGN PATENT DOCUMENTS

| | | | |
|---|---|---|---|
| JP | 05-124208 | A | 5/1993 |
| JP | 2004-042398 | A | 2/2004 |

* cited by examiner

*Primary Examiner* — John A. McPherson
(74) *Attorney, Agent, or Firm* — Fitzpatrick, Cella, Harper & Scinto

(57) ABSTRACT

A method of manufacturing a liquid ejection head includes: exposing a negative organic resin layer to be a flow path forming member except for regions in which an ejection orifice and a fluid resistance portion are to be formed, respectively, and heating the negative organic resin layer and a flow path pattern to move a portion of the negative organic resin layer which corresponds to the fluid resistance portion toward a substrate; and exposing and developing the region of the negative organic resin layer in which the fluid resistance portion is to be formed.

3 Claims, 5 Drawing Sheets

METHOD OF MANUFACTURING LIQUID EJECTION HEAD

BACKGROUND OF THE INVENTION

1. Field of the Invention

The present invention relates to a method of manufacturing a liquid ejection head for ejecting liquid such as ink.

2. Description of the Related Art

Factors which greatly influence characteristics of a liquid ejection head include an ejection orifice, positional relationship between an ejection energy generating element and the ejection orifice, and internal structure of an ink flow path. This is because the volume, the velocity, and the direction of an ejected ink droplet are determined by the above-mentioned positional relationship, flow resistance in the ink flow path, the weight of the ink, and the like. Among these, as factors with regard to the flow resistance, the ejection orifice and the internal structure of the ink flow path are important. With regard to the internal structure of the ink flow path, it is known that, by providing a step in a part of the ink flow path, the velocity and the amount of the ejected ink may be controlled and ink may be ejected with stability.

Japanese Patent Application Laid-Open No. H05-124208 discloses a method in which a step is provided on a side opposed to a substrate surface of an ink flow path (hereinafter, referred to as ink flow path upper side). In the method disclosed in Japanese Patent Application Laid-Open No. H05-124208, by forming a mold material for the ink flow path on a substrate using a photolithography process or the like, providing a mask layer on the mold material, and selectively removing a part of the mold material which is not covered with the mask layer, a fluid resistance portion is formed on the ink flow path upper side.

Further, Japanese Patent Application Laid-Open No. 2004-042398 proposes a method in which, by using on a substrate multiple mold materials formed of different organic resins and repeating photolithography processes, multiple steps to be fluid resistance portions are provided in an ink flow path.

Study by the present inventors has revealed that, in the method disclosed in Japanese Patent Application Laid-Open Nos. H05-124208 or 2004-042398, when the mask layer or an upper side organic resin is selected, it is necessary to select a material which may be patterned without dissolving a mold material directly provided on the substrate and which may be adhered to the mold material.

Further, when an active ray is used in patterning the mask layer or the upper side organic resin, the process is restricted accordingly. For example, patterning is required to be performed in a wavelength range which is different from that of an active ray used in patterning the mold material directly provided on the substrate.

SUMMARY OF THE INVENTION

Accordingly, an object of the present invention is to provide a method of manufacturing a liquid ejection head having on a ceiling of a liquid flow path of the liquid ejection head a fluid resistance portion including a step structure with less restrictions on manufacture and with ease.

According to the present invention, there is provided a method of manufacturing a liquid ejection head, the liquid ejection head including; a substrate having on a first surface side thereof an ejection energy generating element for generating energy for ejecting a liquid droplet, a flow path forming member formed on the first surface and constituting an ejection orifice for ejecting the liquid droplet therefrom and a liquid flow path for supplying liquid to the ejection orifice, and a fluid resistance portion on a wall surface of the liquid flow path opposed to the substrate, the method including:

(1) forming on the first surface of the substrate a flow path pattern to be a mold material of the liquid flow path;

(2) forming on the flow path pattern a negative organic resin layer to be the flow path forming member;

(3) exposing the negative organic resin layer except for regions in which the ejection orifice and the fluid resistance portion are to be formed, respectively, and heating the negative organic resin layer and the flow path pattern to move a portion of the negative organic resin layer which corresponds to the fluid resistance portion toward the substrate;

(4) forming the ejection orifice by exposing and developing the region of the negative organic resin layer in which the fluid resistance portion is to be formed; and (5) removing the flow path pattern.

Further features of the present invention will become apparent from the following description of exemplary embodiments with reference to the attached drawings.

DESCRIPTION OF THE EMBODIMENTS

An embodiment of the present invention is described in the following. It is to be noted that numeric values in examples below are only exemplary and the present invention is not limited thereto. Further, the present invention is not limited to the examples and may be applied to combinations thereof and, further, to technologies which should fall within the scope of the present invention claimed.

Figure 6:
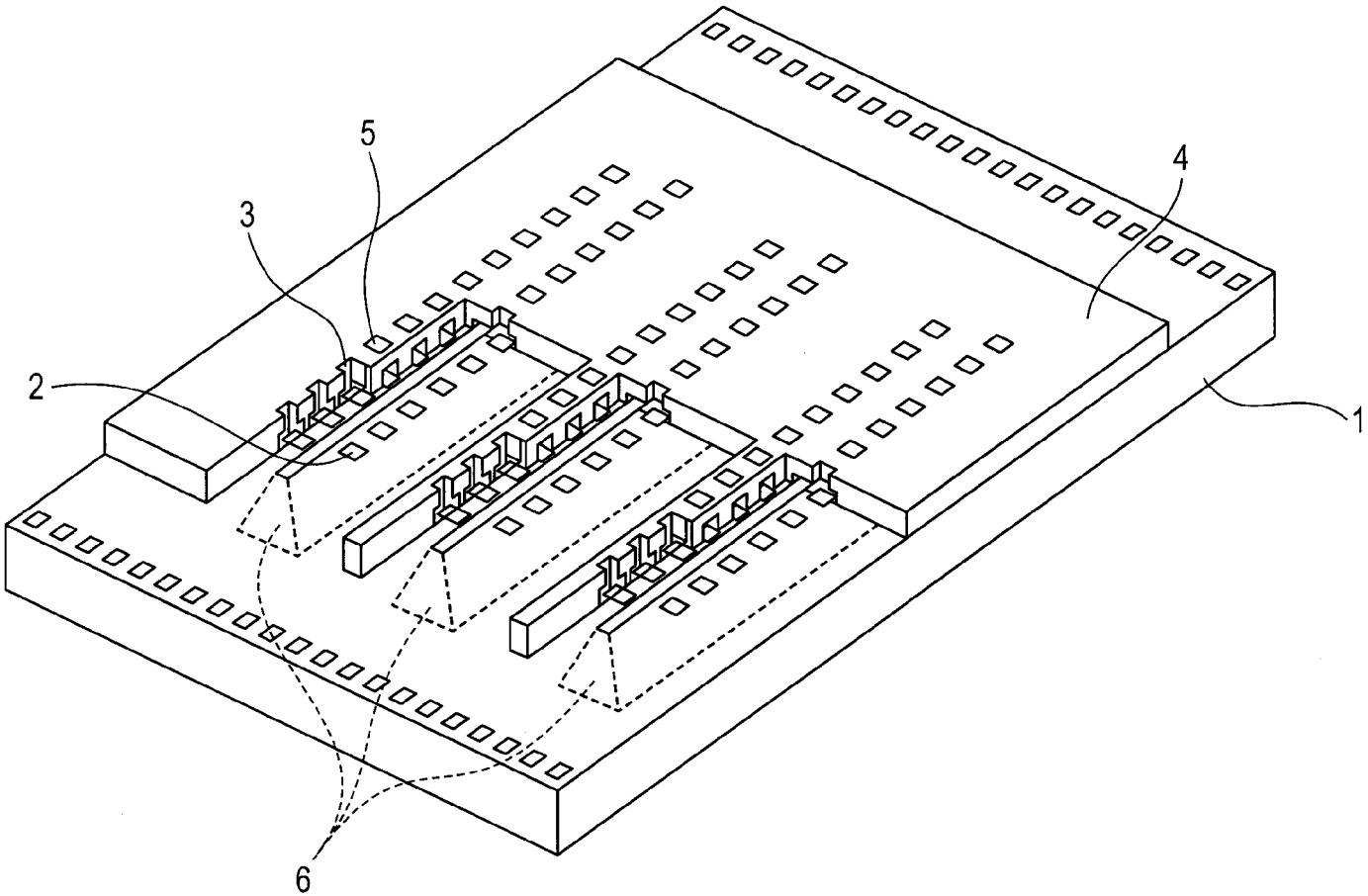
FIG. 6 is a schematic perspective view illustrating an exemplary structure of a liquid ejection head manufactured according to the present invention.

FIG. 6 is a schematic perspective view of a liquid ejection head. In FIG. 6, a flow path forming member 4 is formed on a substrate 1 which is formed of silicon or the like. The flow path forming member 4 includes therein liquid flow paths 3 such as ink flow paths and ejection orifices 5. Ejection energy generating elements 2 are formed on the substrate 1 in the liquid flow paths 3. Energy generated by the ejection energy generating elements 2 causes liquid droplets to be ejected. Further, supply openings 6 for supplying liquid such as ink to the liquid flow paths 3 are formed in the substrate 1.

Figure 1A:
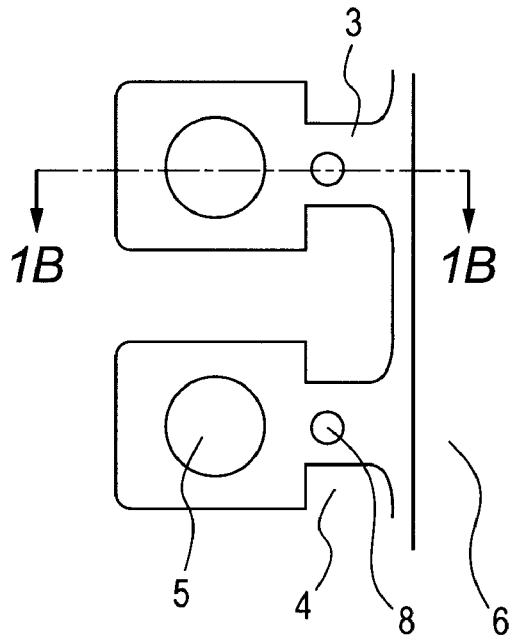
FIGS. 1A and 1B are schematic views illustrating an exemplary structure of a liquid ejection head manufactured according to the present invention.
Figure 1B:
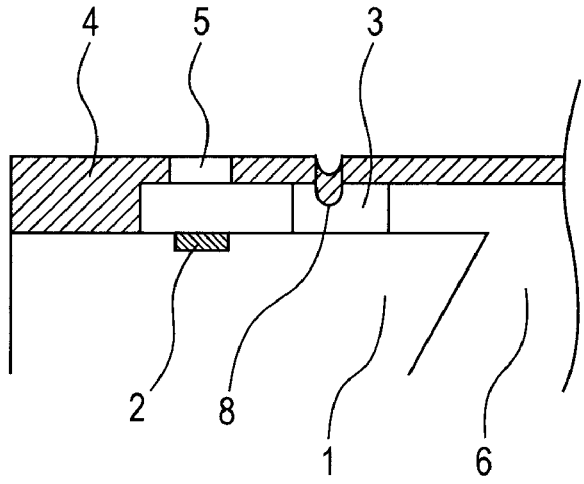

FIGS. 1A and 1B are schematic views illustrating the liquid ejection head of this embodiment. FIG. 1A is a schematic plan view illustrating the liquid ejection head, while FIG. 1B is a schematic vertical sectional view taken along the line 1B-1B of FIG. 1A. In FIGS. 1A and 1B, the flow path forming member 4 including therein the liquid flow path 3 such as an ink flow path and the ejection orifice 5 is formed on the substrate 1, the substrate 1 having on a front surface side (first surface side) thereof the ejection energy generating element 2 for generating energy for ejecting a droplet of liquid such as ink. The supply opening 6 for supplying liquid to the liquid flow path 3 such as an ink supply opening is formed in the substrate 1. Still further, fluid resistance portions 8 are provided on wall surfaces of the liquid flow paths 3, respectively, which are opposed to the substrate 1. The fluid resistance portions 8 are formed as a part of the flow path forming member 4.

FIGS. 2A to 2G illustrate manufacturing process steps of the liquid ejection head illustrated in FIG. 1B according to this embodiment. A manufacturing method according to this embodiment is described in the following with reference to FIGS. 2A to 2G. It is to be noted that, in the following embodiment, a method of manufacturing an ink jet recording head is mainly described, but the present invention is not specifically limited thereto. The liquid ejection head according to the present invention may be used for not only ink recording, but also for manufacturing a biochip and printing an electronic circuit, for example. Exemplary liquid ejection heads include not only an ink jet recording head but also a head for manufacturing a color filter.

Figure 2A:
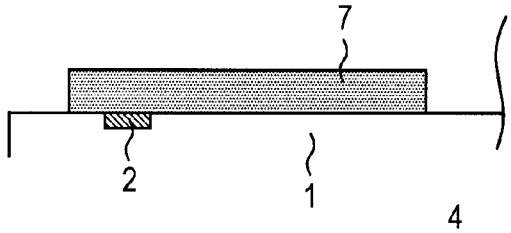
FIGS. 2A, 2B, 2C, 2D, 2E, 2F and 2G are explanatory sectional views illustrating manufacturing process steps of an embodiment of the present invention.

First, as illustrated in FIG. 2A, a flow path pattern 7 to be a mold material of the ink flow path 3 is formed on the substrate 1 having therein the ejection energy generating element 2 for generating energy for ejecting ink (FIG. 2A).

Figure 2B:
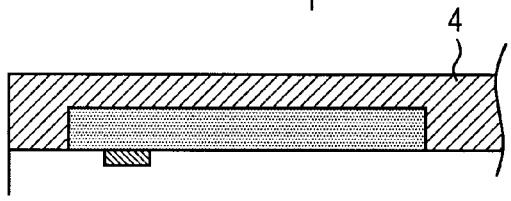

Then, the flow path forming member 4 is formed on the flow path pattern 7 (FIG. 2B).

The flow path forming member 4 is formed by a layer of a negative organic resin such as a negative photosensitive resin. As the negative organic resin layer, a cationically polymerizable compound of an epoxy resin may be preferably used from the viewpoint of mechanical strength, resistance to ink, adherence to the substrate, and the like.

Further, the flow path pattern 7 is required not to be dissolved by the negative organic resin used for the flow path forming member 4, to be able to have minute patterns formed therein, and to be able to be removed after a nozzle is formed, and thus, it is preferred that the flow path pattern 7 be formed by a layer of a positive organic resin such as a positive resist.

Figure 2C:
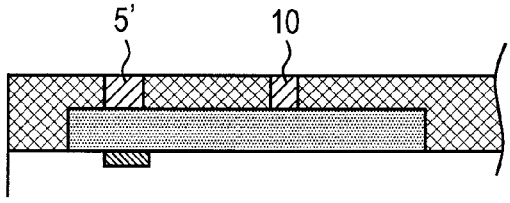

Then, the flow path forming member (negative organic resin layer) 4 is exposed via a mask (not shown) by a photolithography technology. Here, the flow path forming member 4 is exposed (first exposure) except for a fluid resistance forming region 10 in which the fluid resistance portion 8 is to be formed and an ejection orifice forming region 5' in which the ejection orifice 5 is to be formed (FIG. 2C).

Next, the negative organic resin layer 4 and the flow path pattern 7 are heated. Here, it is preferred that the heat treatment (post exposure bake) be performed at a temperature higher than a glass transition temperature of the flow path pattern 7. Further, if the heat treatment is performed at a temperature also higher than a glass transition temperature of an unexposed portion of the negative organic resin layer (flow path forming member 4), movement of the unexposed portions of the negative organic resin layer (flow path forming member 4) may be promoted, which is more preferred.

This heat treatment promotes cure of the exposed portion of the flow path forming member 4 to contract the resin. Further, the flow path pattern 7 softened by being heated behaves so as to follow the cure and contraction of the flow path forming member 4 and so as not to create clearance between the flow path pattern 7 and the flow path forming member 4 when the exposed portion of the flow path forming member 4 is cured and contracted. Therefore, in the fluid resistance forming region 10 which is an unexposed portion of the flow path forming member 4, a portion of the flow path pattern 7 which approximately corresponds in volume to a portion of the flow path forming member 4 which is cured and contracted forms a depression. Further, the unexposed portion of the flow path forming member 4 is not cured and the liquidity thereof is high by being heated, and thus, the unexposed portion of the flow path forming member 4 moves so as to follow the depression in the flow path pattern 7. More specifically, the portion of the negative photosensitive resin layer 4 which corresponds to the fluid resistance portion 8 moves toward the substrate 1. The fluid resistance forming region 10 which is an unexposed portion of the flow path forming member 4 follows the depression of the flow path pattern 7 and becomes a protrusion to form the fluid resistance portion 8.

It is to be noted that the shape and location of the depression of the flow path pattern 7, that is, the shape and location of the fluid resistance portion 8 may be controlled by appropriately selecting a mask pattern according to characteristics required for the head used. Further, the depth of the depression, that is, the height of the fluid resistance portion 8 may be controlled by the amount of the exposure, the temperature and duration of the heat treatment, the thickness of the flow path forming member 4, and the like.

Figure 2D:
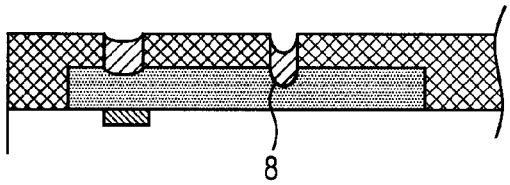
Figure 2E:
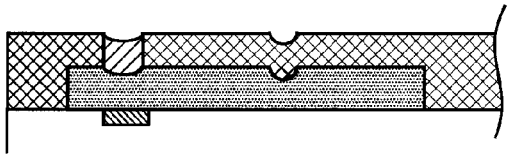

Then, via a mask (not shown), at least the fluid resistance portion 8 of the flow path forming member 4 is exposed (second exposure) except for the ejection orifice forming region 5' (FIG. 2E).

Figure 2F:
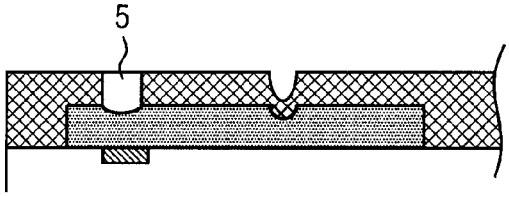

After that, heat treatment (post exposure bake) is performed again as necessary, and then development is performed to form the ejection orifice 5 (FIG. 2F).

Figure 2G:
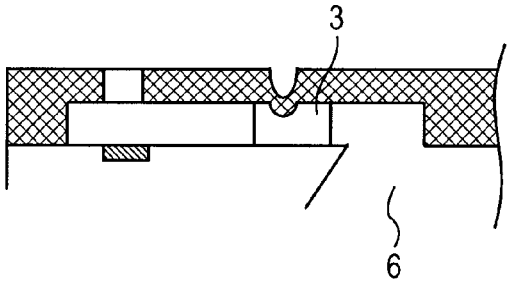

Then, a mask (not shown) for forming the ink supply opening 6 is located on a rear surface of the substrate 1. After a front surface of the substrate 1 is protected by a rubber film (not shown) or the like, anisotropic etching of the substrate 1 is performed to form the ink supply opening 6. After the anisotropic etching is performed, the rubber film is removed, and a solvent is used to dissolve and remove the flow path pattern 7 (FIG. 2G).

Further, in order to completely cure the flow path forming member 4, a heating process may be performed at 200° C. for one hour.

Finally, members for electrical connection and ink supply are appropriately located to form the liquid ejection head.

In the following, examples of the present invention are described, but the present invention is not specifically limited thereto.

EXAMPLE 1

In this example, the manufacturing process steps illustrated in FIGS. 2A to 2G were used to form the liquid ejection head illustrated in FIG. 6.

First, polymethyl isopropenyl ketone ("ODUR-1010" manufactured by TOKYO OHKA KOGYO CO., LTD.) as a material of the flow path pattern 7 was applied at a thickness of 10 μm to the substrate 1 formed of silicon having the ejection energy generating element 2 formed therein, and heat treatment was performed at 120° C. for 6 minutes. Then, exposure and development were carried out to form the flow path pattern 7 of the ink flow path 3 (FIG. 2A). In this example, the width of the ink flow path 3 was 30 μm.

Then, a resist which is formed from a cationically photopolymerizable resin (manufactured by NIPPON KAYAKU Co., Ltd. under the trade name of SU-8 3045) as the flow path forming member 4 was applied onto the flow path pattern 7 at a thickness of 15 μm measured from the substrate 1, and heat treatment was performed at 95° C. for 10 minutes (FIG. 2B).

Next, an i-line exposure stepper (manufactured by Canon Inc.) was used to expose the flow path forming member 4 at 2,500 J/m$^2$ except for the ejection orifice forming region 5' and the fluid resistance forming region 10 (FIG. 2C).

Then, heat treatment was performed at 120° C. for 4 minutes to cure the exposed portion while softening the flow path pattern 7, depressing the unexposed portions of the flow path forming member 4 thereover to form the depressions, and forming the fluid resistance portion 8 in the flow path forming member 4 (FIG. 2D).

It is to be noted that, here, the sizes of the ejection orifice 5 and the fluid resistance portion 8 on the mask were Φ22 μm and Φ15 μm, respectively.

Then, a region including at least the fluid resistance portion 8 and excluding the ejection orifice forming region 5' was exposed at 3,500 J/m$^2$ using the i-line exposure stepper to cure the fluid resistance portion 8 (FIG. 2E).

After heat treatment (post exposure bake) at 90° C. for 4 minutes, development was performed with propylene glycol monomethyl ether acetate to form the ejection orifice 5 (FIG. 2F).

Then, the ink supply opening 6 was formed in the above-mentioned method, ultraviolet irradiation was performed on the whole surface to decompose the flow path pattern 7, and methyl lactate was used to dissolve and remove the flow path pattern 7 to manufacture the liquid ejection head.

The ink flow path 3 of the obtained liquid ejection head was cut in section and the dimensions of the fluid resistance portion 8 were measured. The result was that the diameter at a level of a ceiling of the ink flow path 3 was 15 μm while the height was 5 μm.

Further, when the manufacturing process was suspended at the step illustrated in FIG. 2D to observe the sections of the ejection orifice forming region 5' and of the fluid resistance portion 8, a depression was observed in each of the portions of the flow path pattern 7 to be the ejection orifice forming region 5' and the fluid resistance portion 8. Further, the depression in the fluid resistance portion 8 was deeper than that in the ejection orifice forming region 5'. The diameter of the exposure was smaller in the fluid resistance portion 8 than that in the ejection orifice forming region 5'.

In this example, a positive resist containing polymethyl isopropenyl ketone was used as the flow path pattern 7. The glass transition temperature of the material was about 70° C. Therefore, by providing the heat treatment after the exposure of the flow path forming member 4 at a temperature higher than the glass transition temperature, a depression may be formed in the flow path pattern 7. Therefore, when polymethyl isopropenyl ketone is used as the flow path pattern 7, it is preferred that the heat treatment be performed in a temperature range of 100° C. to 140° C. In this temperature range, the flow path pattern 7 may be removed without deteriorating polymethyl isopropenyl ketone and without conducting a specially difficult work.

Figure 4A:
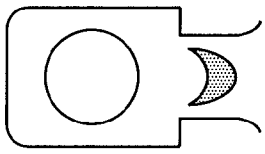
FIGS. 4A, 4B and 4C are schematic views illustrating exemplary shapes of a fluid resistance portion formed according to the present invention.
Figure 4B:
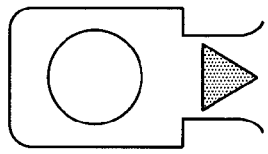
Figure 4C:
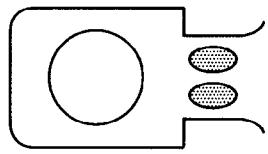

Further, in this example, the fluid resistance portion 8 was formed so that a section thereof at the level of the ceiling of the liquid flow path 3 was circular in shape, but the shape may be as illustrated in FIG. 4A, 4B, or 4C. In FIGS. 4A and 4B, the section of the fluid resistance portion 8 at the level of the ceiling of the liquid flow path 3 is such that the shape thereof on the ejection energy generating element 2 side is concave or flat. Further, a plurality of the fluid resistance portions 8 may be formed in the liquid flow path 3 from the supply opening 6 to one ejection orifice 5 (see, for example, FIG. 4C). Further, it is preferred that the fluid resistance portion 8 be formed in a shape which is optimum for stable ejection.

Further, although not described in this example, a water-repellent layer may be formed on top of the flow path forming member 4. The water-repellent layer is required to have ink repellency and high mechanical strength against a wipe accompanied with contact with a wiper or the like. Therefore, a negative resist containing a water-repellent functional group such as fluorine or silicon, or a condensate containing a hydrolyzable silane compound which has a fluorine containing group and a hydrolyzable silane compound which has a cationically polymerizable group is preferably used. The method of forming the water-repellent layer may be appropriately selected. For example, the water-repellent layer may be formed after the application and the heat treatment of the flow path forming member 4 and may be patterned simultaneously with the exposure of the flow path forming member 4.

EXAMPLE 2

Figure 3A:
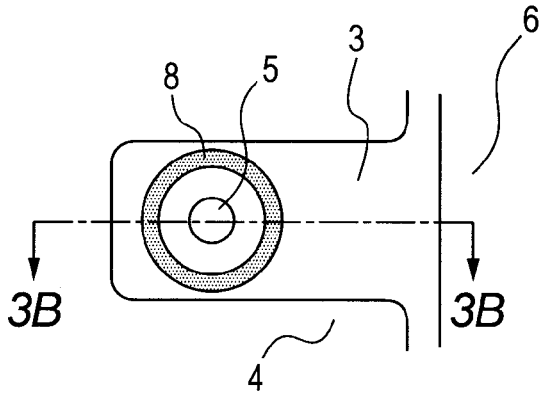
FIGS. 3A and 3B are schematic views illustrating an exemplary structure of a liquid ejection head manufactured according to the present invention.
Figure 3B:
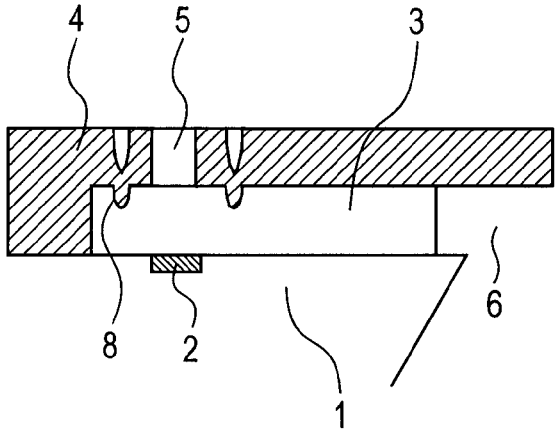

In this example, a liquid ejection head illustrated in schematic views of FIGS. 3A and 3B was manufactured. FIG. 3A is a schematic plan view of the liquid ejection head while FIG. 3B is a schematic vertical sectional view taken along the line 3B-3B of FIG. 3A.

In this example, the height of the ink flow path 3 was 15 μm, the height of the flow path forming member 4 was 25 μm (the thickness of the flow path forming member 4 constituting the ceiling of the ink flow path 3 was 10 μm), the width of the ink flow path 3 was 34 μm, and the diameter of the ejection orifice 5 was Φ13 μm.

As illustrated in FIGS. 3A and 3B, the fluid resistance portion 8 was formed so as to be concentric with the ejection orifice 5 and so as to have a diameter range of Φ25 to Φ30 μm. More specifically, in the first exposure of the flow path forming member 4, a mask was used to expose the flow path forming member 4 except for the above-mentioned diameter range of Φ25 to Φ30 μm and the diameter range of the ejection orifice 5 of Φ13 μm. It is to be noted that the liquid ejection head was manufactured in manufacturing process steps similar to those of Example 1 except that the dimensions of the ink flow path 3 and of the ejection orifice 5 and the shape and the dimensions of the fluid resistance portion 8 were changed.

The liquid ejection head formed in this way was cut in section and the dimensions of the fluid resistance portion 8 were measured. The fluid resistance portion 8 was formed so as to have an outer diameter of 30 μm, an inner diameter of 25 μm, and a height of 5 μm. By forming in this way the fluid resistance portion 8 around the ejection orifice 5 on the ink flow path 3 side, the velocity of the ejected liquid droplet may be made higher and the amount of the ejected liquid droplet may be stabilized more efficiently. In other words, the fluid resistance portion 8 may be formed around the ejection orifice 5 on the liquid flow path 3 side.

In this example, the fluid resistance portion 8 was formed so as to be concentric with the ejection orifice 5, but the shape may be determined otherwise taking into consideration the optimum ejection. For example, the shape may be an ellipse. Further, in this example, the fluid resistance portion 8 was formed so that the outer contour thereof and the inner contour thereof are similar in shape, but the fluid resistance portion 8 may be formed otherwise taking into consideration the optimum shape for stabilizing the ejection. For example, the outer contour of the fluid resistance portion 8 may be formed so as to follow the shape of the ink flow path 3.

EXAMPLE 3

In this example, a liquid ejection head was manufactured by a manufacturing method illustrated in FIGS. 5A to 5J. FIGS. 5A to 5J are sectional views based on a section taken along the line 1B-1B of FIG. 1A illustrating manufacturing process steps of the liquid ejection head.

Figure 5A:
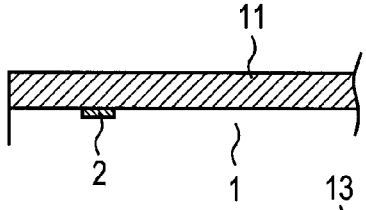
FIGS. 5A, 5B, 5C, 5D, 5E, 5F, 5G, 5H, 5I and 5J are explanatory sectional views illustrating manufacturing process steps of an example of the present invention.

A flow path forming wall material 11 to be an ink flow path wall 13 was formed on the substrate 1 having the ejection energy generating element 2 for generating energy for ejecting ink provided therein (FIG. 5A). As the flow path forming wall material 11 as used in the present invention, similarly to the case of the flow path forming member 4 in Example 1, an SU-8 resist which is formed from a cationically photopolymerizable resin (manufactured by NIPPON KAYAKU Co., Ltd. under the trade name of SU-8 3015) was used.

Figure 5B:
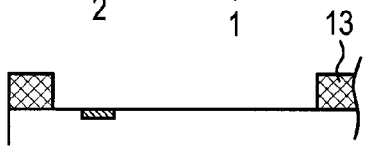

Next, an i-line exposure stepper (manufactured by Canon Inc.) was used to expose the flow path forming wall material 11 at 3,500 J/m$^2$ except for a portion to be the flow path pattern 7, and heat treatment (post exposure bake) was performed at 95° C. for 10 minutes. Then, development was performed with propylene glycol monomethyl ether acetate to form the ink flow path wall 13 (FIG. 5B).

Figure 5C:
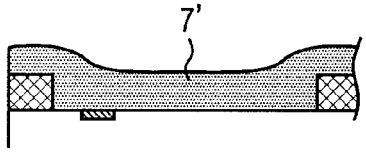

Then, a dissolvable material 7' of the flow path pattern 7 was provided on the ink flow path wall 13 (FIG. 5C).

The thickness of the flow path pattern material 7' thus provided was made to be sufficiently larger than the height of the ink flow path wall 13. Methods of providing the flow path pattern material 7' include spin coating, direct coating, and laminate transfer, but the present invention is not limited thereto. It is to be noted that, in this example, a cresol novolac resin was used as the flow path pattern material 7'.

Figure 5D:
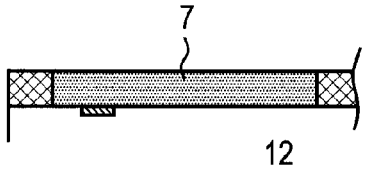

Then, the flow path pattern material 7' was polished and the flow path pattern 7 embedded in a region surrounded by the ink flow path wall 13 was formed (FIG. 5D).

As the polishing method, chemical mechanical polishing (CMP), which is a chemical mechanical polishing technology using slurry, may be used. In this case, the ink flow path wall 13 which is previously formed of a negative photosensitive resin is sufficiently cross-linked. Thus, there is a hardness difference between the ink flow path wall 13 and the flow path pattern material 7' which is formed of the dissolvable resin applied thereon, and the ink flow path wall 13 sufficiently acts as a polish stop layer. This enables stable polish of the flow path pattern material 7' formed of a dissolvable resin down to the negative photosensitive resin layer, and the thickness of the flow path pattern 7 may be obtained with good reproducibility. As abrasive grain used in the polishing, alumina, silica, or the like may be used.

Figure 5E:
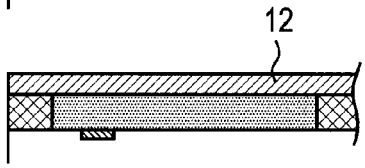

Then, by laminating a negative dry film resist (hereinafter, also referred to as DF) on the ink flow path wall 13 and the flow path pattern 7, an ejection orifice plate 12 was formed (FIG. 5E). The DF was manufactured by forming a dry film of the above-mentioned SU-8 resist (trade name of a product manufactured by NIPPON KAYAKU Co., Ltd.). Further, after the lamination, heat treatment was performed at 95° C. for 10 minutes.

Figure 5F:
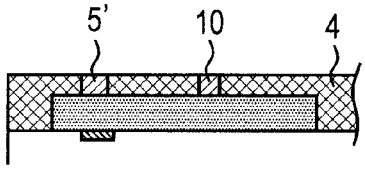

Next, the ejection orifice plate 12 was exposed via a mask (not shown) by photolithography technology except for the fluid resistance forming region 10 and the ejection orifice forming region 5' (FIG. 5F).

Figure 5G:
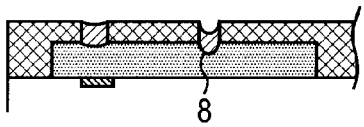

Then, heat treatment was performed at a temperature higher than the glass transition temperature of the flow path pattern 7 to form a depression in the flow path pattern 7. Further, the flow path forming member 4 formed a protrusion according to the depression, thereby forming the fluid resistance portion 8 (FIG. 5G).

Figure 5H:
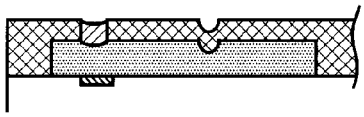

Next, exposure of a region including the fluid resistance portion 8 but excluding the ejection orifice forming region 5' was carried out via a mask (not shown) (FIG. 5H).

Figure 5I:
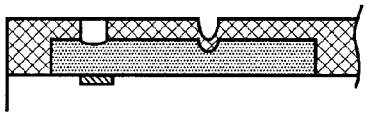

Then, heat treatment was performed and development was performed to form the ejection orifice 5 (FIG. 5I).

Figure 5J:
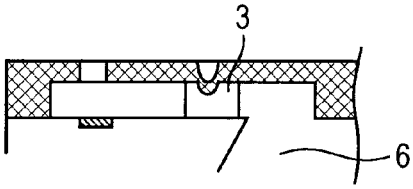

After that, by going through the above-described process steps, the ink supply opening 6 was formed, and a solvent was used to dissolve and remove the flow path pattern 7 to manufacture the liquid ejection head (FIG. 5J).

The ink flow path 3 of the obtained liquid ejection head was cut in section and the dimensions of the fluid resistance portion 8 were measured. The fluid resistance portion 8 which was formed had a diameter at the level of the ceiling of the ink flow path 3 of 15 μm and a height of 5 μm.

It is to be noted that, in this example, the ejection orifice plate 12 was formed by laminating the DF, but methods including spin coating, direct coating, and spray coating may also be used.

According to the present invention, the fluid resistance portion may be formed with less restrictions on manufacture and with ease.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-166001, filed Jul. 23, 2010, which is hereby incorporated by reference herein in its entirety.

What is claimed is:

1. A method of manufacturing a liquid ejection head, the liquid ejection head comprising:

a substrate having on a first surface side thereof an ejection energy generating element for generating energy for ejecting a liquid droplet;

a flow path forming member formed on the first surface and constituting an ejection orifice for ejecting the liquid droplet therefrom and a liquid flow path for supplying liquid to the ejection orifice; and a fluid resistance portion on a wall surface of the liquid flow path opposed to the substrate, the method comprising:

(1) forming on the first surface of the substrate a flow path pattern to be a mold material of the liquid flow path;

(2) forming on the flow path pattern a negative organic resin layer to be the flow path forming member;

(3) exposing the negative organic resin layer except for regions in which the ejection orifice and the fluid resistance portion are to be formed, respectively, and heating the negative organic resin layer and the flow path pattern to move a portion of the negative organic resin layer which corresponds to the fluid resistance portion toward the substrate;

(4) forming the ejection orifice by exposing and developing the region of the negative organic resin layer in which the fluid resistance portion is to be formed; and (5) removing the flow path pattern.

2. A method of manufacturing a liquid ejection head according to claim 1, wherein the flow path pattern is formed of a positive organic resin.

3. A method of manufacturing a liquid ejection head according to claim 1, wherein the fluid resistance portion forms a protrusion on the wall surface of the liquid flow path opposed to the substrate.

* * * * *

UNITED STATES PATENT AND TRADEMARK OFFICE

CERTIFICATE OF CORRECTION

PATENT NO. : 8,268,539 B2
APPLICATION NO. : 13/177765
DATED : September 18, 2012
INVENTOR(S) : Ikegame et al.

It is certified that error appears in the above-identified patent and that said Letters Patent is hereby corrected as shown below:

On the cover page, at (73): "Caron" has been changed to read --Canon--.

Signed and Sealed this
Nineteenth Day of February, 2013

Teresa Stanek Rea
*Acting Director of the United States Patent and Trademark Office*